United States Patent [19]

Pringle

[11] Patent Number: 4,629,002

[45] Date of Patent: Dec. 16, 1986

[54] EQUALIZING MEANS FOR A SUBSURFACE WELL SAFETY VALVE

[75] Inventor: Ronald E. Pringle, Houston, Tex.

[73] Assignee: Camco, Incorporated, Houston, Tex.

[21] Appl. No.: 789,234

[22] Filed: Oct. 18, 1985

[51] Int. Cl.[4] ..... E21B 34/12

[52] U.S. Cl. ..... 166/324

[58] Field of Search ..... 166/321, 324, 319

[56] References Cited

U.S. PATENT DOCUMENTS

| | | | |
|---|---|---|---|
| 3,845,818 | 11/1974 | Deaton | 166/324 |
| 4,007,798 | 2/1977 | Gazda | 175/297 |
| 4,161,219 | 7/1979 | Pringle . | |
| 4,325,431 | 4/1982 | Akkerman . | |
| 4,373,587 | 2/1983 | Pringle | 166/324 |
| 4,454,913 | 6/1984 | Guidry et al. . | |

*Primary Examiner*—Stephen J. Novosad
*Assistant Examiner*—Terry Lee Melius
*Attorney, Agent, or Firm*—Fulbright & Jaworski

[57] ABSTRACT

In combination with a subsurface safety valve for controlling fluid flow through a well tubing of an equalizing system for reducing the pressure differential across the first valve. A housing includes an equalizing line in communication with the bore between points above and below the first valve. An equalizing valve is positioned in the line, operated from hydraulic pressure and opens prior to the opening of the first valve. A labyrinth passageway is provided in the equalizing line upstream of the equalizing valve for providing pressure drops for controlling the velocity of the fluid flowing through the equalizing valve. A seal is provided in the housing to engage the flow tube in its open position for blocking fluid flow in the equalizing line. The equalizing valve closes before the first valve starts to close thereby preventing flow through the equalizing valve. Preferably the labyrinth passageway includes a plurality of grooves and ridges.

7 Claims, 5 Drawing Figures

11
14
10
32
12
60
66
33
64
64
62
50
58
82
2
2
68
46
56
54
52
42

EQUALIZING MEANS FOR A SUBSURFACE WELL SAFETY VALVE

BACKGROUND OF THE INVENTION

It is known as disclosed in U.S. Pat. Nos. 4,325,431 and 4,454,913 to use a hydraulically actuated equalizing valve for equalizing the pressure above and below a subsurface safety valve prior to opening the safety valve. While this protects the main valve in the subsurface safety valve the equalizing valve is subject to failure as a result of the erosion and flow cutting of the equalizing valve element and seat due to the high pressures and high velocities flowing through the equalizing valve.

The present invention is directed to the combination of an improved equalizing system for use with a subsurface safety valve which controls the pressure drop and velocity of the fluid flow through the equalizing system for preventing erosion and allowing an increased life and dependability of the equalizing valve.

SUMMARY

The present invention is directed to the combination of a subsurface well safety valve and equalizing means. The safety valve controls fluid flow through a well tubing and has a housing with a first valve being movable between an open and closed position for controlling flow through the housing and a flow tube is telescopically movable in the housing for controlling the opening and closing of the first valve and means are provided for moving the flow tube. The equalizing means is for reducing the pressure differential across the first valve when opening the first valve. The equalizing means includes an equalizing line in communication with the inside of the housing between points below and above the first valve. An equalizing valve is provided in the line which opens prior to the opening of the first valve. A labyrinth passageway is provided in the equalizing line upstream of the equalizing valve for providing pressure drops and controlling the velocity of the fluid flowing through the equalizing valve.

Still a further object of the present invention is wherein the labyrinth passageway includes a plurality of grooves and ridges.

Yet a still further object of the present invention is the provision of a seal in the housing in position for engagement by the flow tube when the flow tube is in the open position for blocking fluid flow through the equalizing line.

Yet a still further object of the present invention is the provision of an annular recess in communication with the equalizing line above the equalizing valve for pumping cleaning fluid through the equalizing valve.

Still a further object of the present invention is wherein the area of the equalizing valve exposed to hydraulic control fluid is approximately equal to the area of the equalizing valve exposed to pressure in the bore of the housing below the first valve.

Yet a still further object of the present invention is wherein the equalizing valve closes before the first valve starts to close thereby preventing flow through the equalizing valve when the first valve closes.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1A:
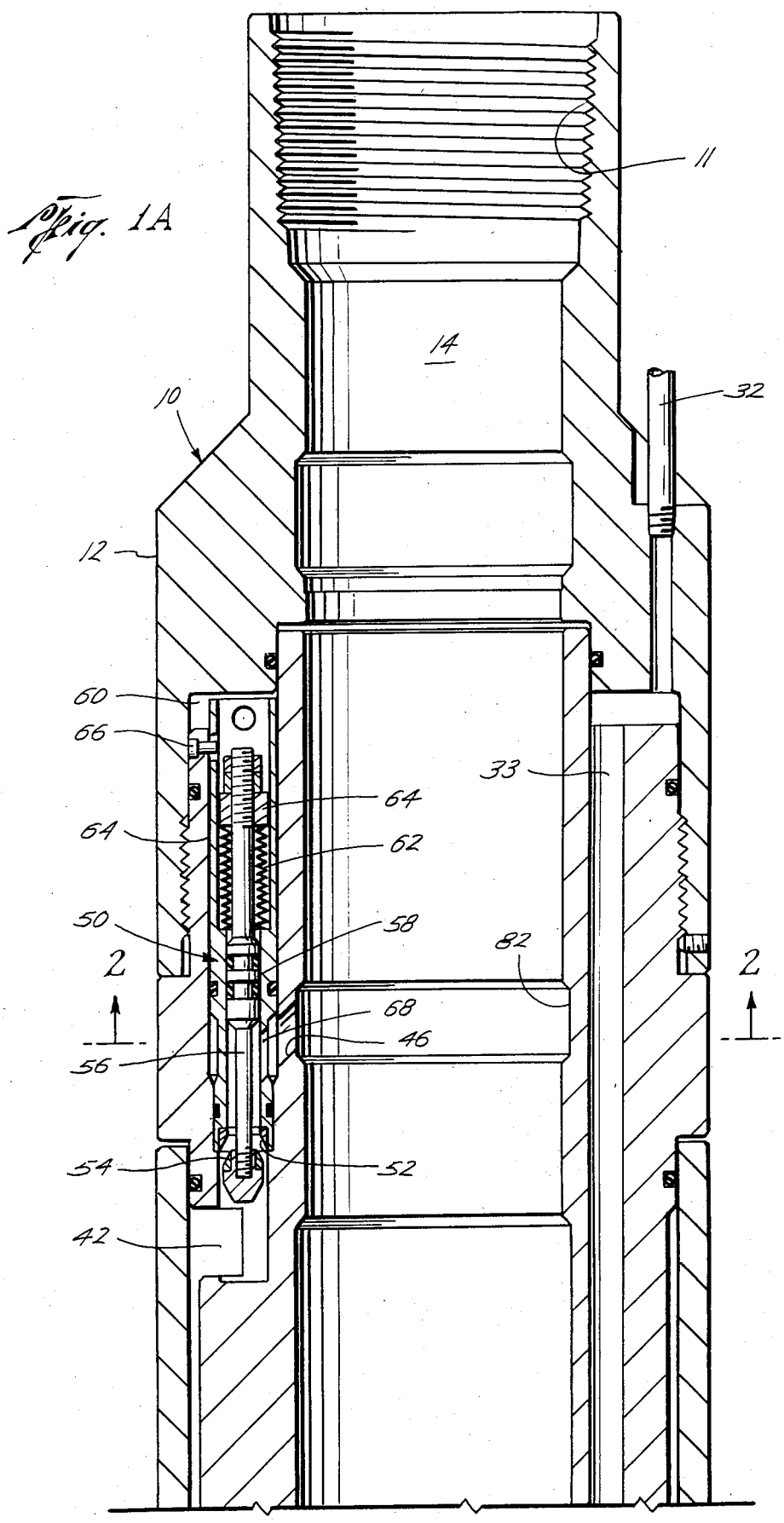
FIGS. 1A, 1B and 1C are continuations of each other and form an elevational view, in cross section, of a subsurface safety valve utilizing the equalizing valve of the present invention.

While the present improvement of an equalizing valve system for use in a subsurface safety valve will be described in connection, for purposes of illustration only, as incorporated in a flapper-type tubing retrievable safety valve, it will be understood that the present equalizing system may be used with other types of subsurface safety valves.

Referring now to the drawings, the subsurface safety valve of the present invention is generally indicated by the reference numeral 10 and is shown as being of a non-retrievable type for connection in a well conduit or tubing (not shown) such as by a threaded box 12 at one end and a threaded pin 13 at the other end for connecting the safety valve 10 directly into the well tubing of an oil and/or gas well. The safety valve 10 generally includes a body or housing 12 adapted to be connected to a well tubing to permit well production therethrough under normal operating conditions but in which the safety valve 10 may close or be closed in response to abnormal conditions.

The safety valve 10 generally includes a bore 14, an annular valve seat 16 (FIG. 1C), a valve closure element or flapper valve 18 connected to the body 12 by a pivot pin 20. A flow tube 22 is telescopically movable in the body 12 and through the valve seat 16. As best seen in FIG. 1C, when the flow tube 22 is moved to a downward position, the tube 22 pushes the flapper 18 away from the valve seat 16. Thus the valve 10 is held in the open position so long as the flow tube 22 is in the downward position. When the flow tube 22 is moved upwardly, the flapper 18 is allowed to move upwardly onto the seat 16 by the action of a spring 24.

Various forces are provided to act upon the flow tube 22 to control the opening and closing of the flapper 18. Thus, biasing means, such as a spring 26, may act between a shoulder 28 on the valve body 12 and a shoulder 30 connected to the flow tube 22 for yieldably urging the flow tube 22 in an upward direction to release the flapper 18 for closing the valve 10. The valve 10 is controlled by the application or removal of a pressurized fluid, such as hydraulic fluid, through a control path or line, such as control line 32 (FIG. 1A), extending to the well surface or the casing annulus for supplying a pressurized hydraulic fluid to passageway 33 and to the top of one or more pistons 40 which in turn act on the flow tube 22 to move the flow tube downwardly forcing the flapper 18 off of the seat 16 and into the full open position. If the fluid pressure in the conduit 32 is reduced sufficiently relative to the forces urging the flow tube 22 upwardly, the flow tube 22 will be moved upwardly beyond the seat 16 allowing the valve 10 to close.

The above description of one type of subsurface safety valve is generally disclosed in U.S. Pat. No. 4,161,219.

Once the valve 10 is closed with the flapper valve element 18 seated on the seat 16 it is usual that there is a greater existing pressure in the bore 14 below the flapper 18 than above the flapper 18. This holds the flapper 18 seated with a high differential pressure and it is therefore desirable to equalize the pressure across the flapper 18 before reopening in order to be able to open the flapper against the differential pressure and to prevent the high velocities of fluid flow through the opening flapper 18 in valve seat 16 from being damaged by erosion. Therefore, it is conventional to utilize an equalizing valve which is opened prior to the opening of the first valve or flapper 18 to equalize pressure across the flapper 18. However, the equalizing valve itself may fail as the result of the fluid flow erosion due to high velocity flow and/or high pressure for an extended period of time.

Figure 1B:
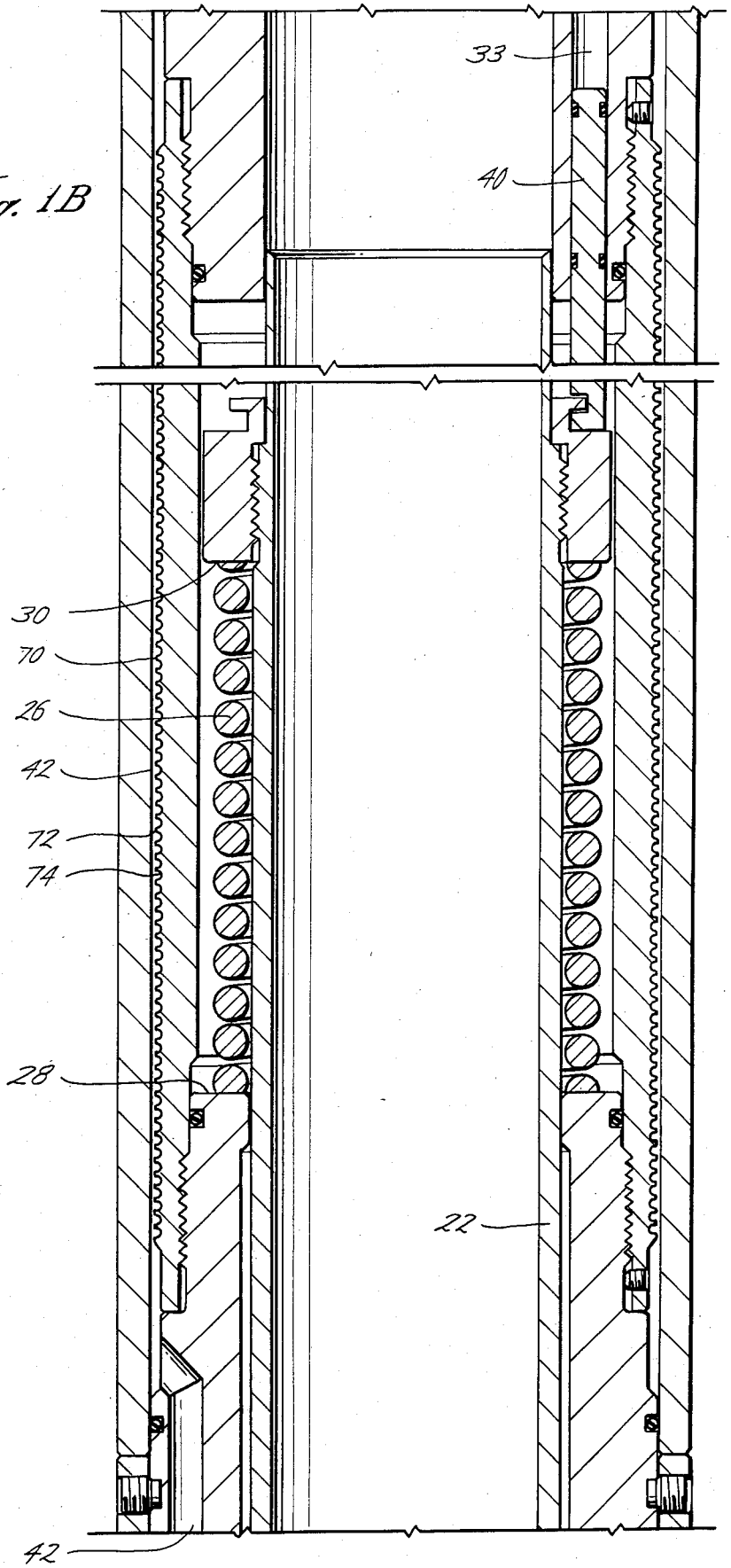
Figure 1C:
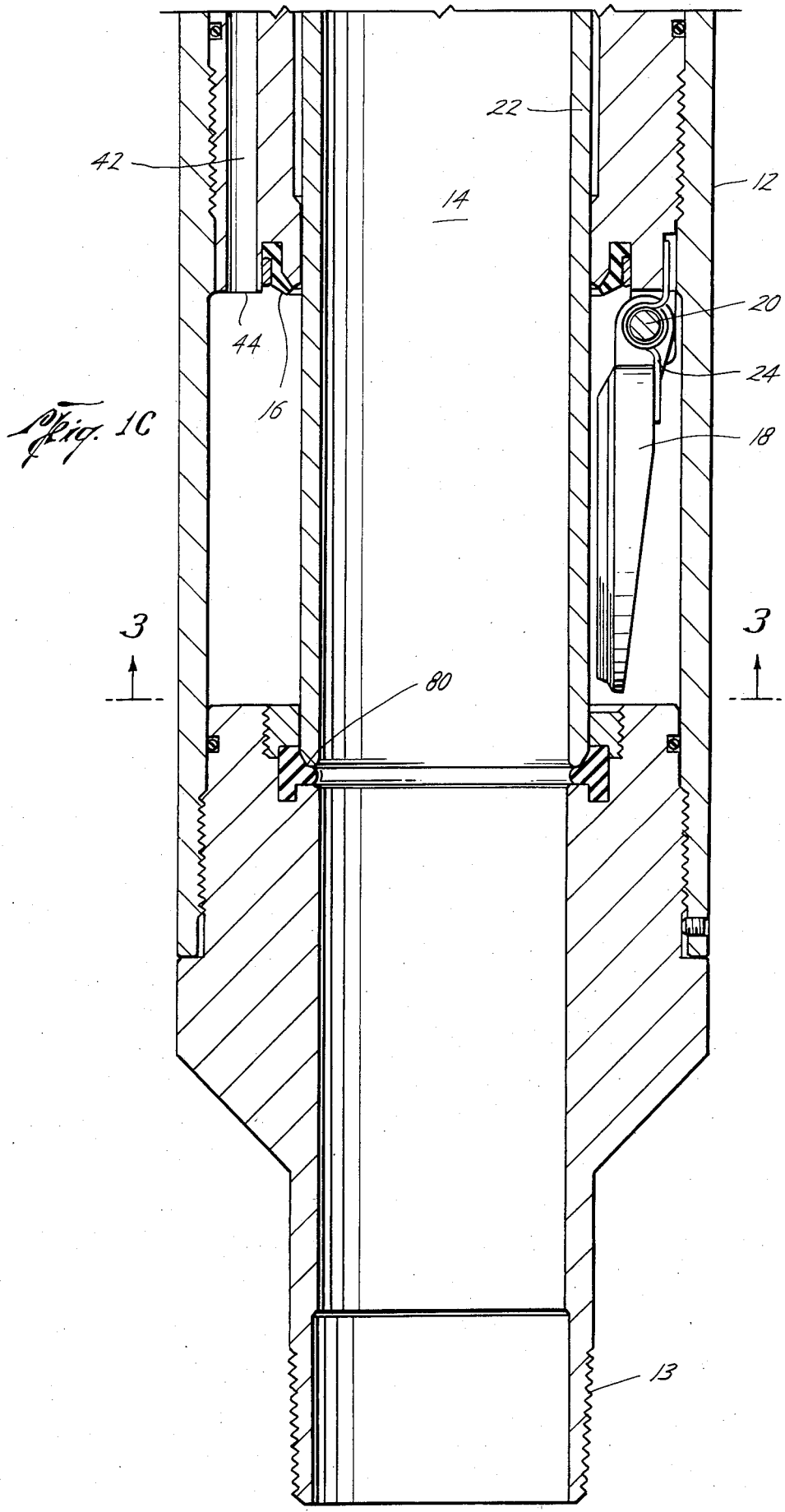
Figure 2:
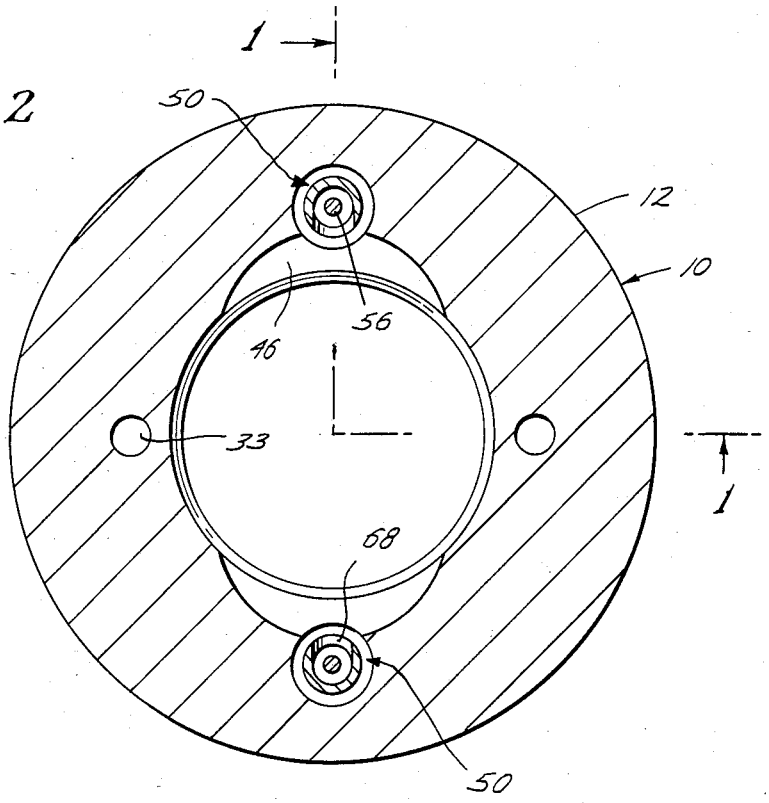
FIG. 2 is a cross-sectional view taken along the line 2—2 of FIG. 1A.
Figure 3:
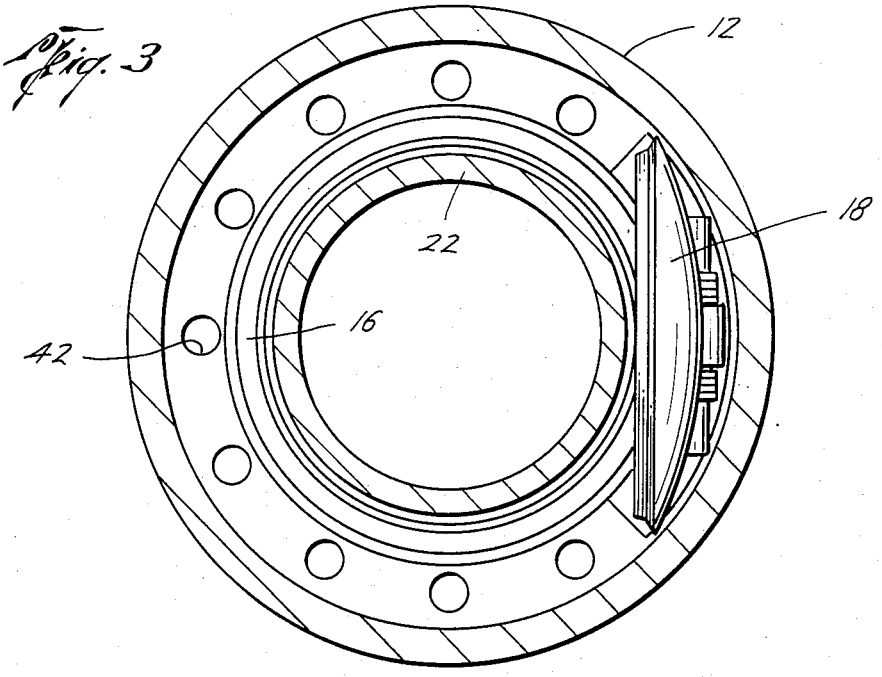
FIG. 3 is a cross-sectional view taken along the line 3—3 of FIG. 1C.

Referring now to FIGS. 1A, 1B and 1C, one or more equalizing lines and equalizing valves, here shown as two, are provided in the housing 12 having a lower end 44 in communication with the space below the valve seat 16 and an upper end extending through port 46 into the upper portion of the bore 14. Thus when the equalizing line 42 is opened fluid may flow from below the first valve consisting of the flapper 18 and valve seat 16 (when the flapper 18 is closed as will be more fully described hereinafter) and up through the port 46 and into the bore 14 above the flapper 18.

An equalizing valve generally indicated by the reference numeral 50 is provided in each equalizing line 42 and consists of a valve seat 52 and a valve element 54. When the valve element 54 is seated on the seat 52 the equalizing line 42 is closed. An actuating stem 56 is connected to the valve element 54 and to a piston 58 which is exposed on its top side to hydraulic control pressure leading to the well surface such as being in communication with a passageway 60 which in turn is in communication with the conduit 32 and fluid passageway 33 to the pistons 40. However the piston 58 may be in communication with a separate hydraulic control line to the well surface. Therefore, the application of hydraulic pressure to the top of the piston 58 acts in a direction to move the valve element 54 off of the seat 52 and open the equalizing valve. The equalizing valve 50 is biased to a closed position by a spring 62 acting between the body 63 of the valve 50 and a threaded nut 64 on the valve stem 56 which is adjustable for adjusting the force of the spring 62 for opening and closing the equalizing valve 50. It is to be noted that the equalizing valve 50 is a replaceable cartridge in which the entire body 63 and components may be removed if desired and be replaced with a blank dummy valve in safety valves not requiring an equalizing valve. The body 63 is held in place in the housing 12 by an orientation pin 66 to align the port 68 in the valve body 63 with the port 46 of the equalizing line 42.

Referring now to FIG. 1B, the equalizing line 42 includes a labyrinth passageway 70 for creating control pressure drops along the equalizing line 42 to reduce the pressure and flow velocity through the equalizing line 42 to minimize the flow cutting and erosion of the equalizing valve element 54 and seat 52 thereby increasing the life of the equalizing valve 50. While the labyrinth passageway may be of any suitable undultory passageway which offers resistance to fluid flow the preferred form is an alternate series of ridges 72 and grooves 74 which extend along the equalizing line 42 and are positioned upstream of the equalizing valve 50. For example only, while the pressure of the well fluid at the lower end of the equalizing line 42 at end 44 is 5,000 psi, by the provision of the multiple pressure drops across the plurality of grooves 74 and ridges 72 the pressure could be dropped to any desired amount, such as, for example, 200 psi, and slowing the velocity of the equalizing fluid flowing through the equalizing line 42 thereby preventing high velocity fluid flow through the valve 50. The clearance of the ridges 72 from the outer wall may suitably be from ten to twenty thousands of an inch. In addition, the combined area of both equalizing valves 50 should be at least twice the annulus area 73 between the ridges 72 and the outer wall for further reducing flow velocity through the valves 50.

In addition, the labyrinth passageway 70 may also act as a solids and debris catcher in view of its length for keeping debris out of the equalizing valve 50. If desired, the labyrinth passageway 70 may be hard coated without finished machining while of course, the length of the labyrinth passageway 70 may be made to accommodate the particular pressures involved in the well. The advantage of the labyrinth passageway 70 is that it can be sized to obtain total control of the pressure drop and velocities through the equalizing line 42 for reducing erosion of the equalizing valve 50.

Preferably, the cross-sectional area of the piston section 58 of the equalizing valve 50 is approximately equal to the area of the valve seat 52 to provide an approximate 1:1 ratio of hydraulic fluid pressure acting on the top side of the piston 58 to counteract the fluid pressure in the well tubing acting on the valve element 54.

The nut 64 is adjusted on the stem 56 to adjust the force in the spring 62 of the equalizing valve 50 to lift the hydrostatic head and to insure that the equalizing valve 50 will open prior to the opening of the first valve consisting of the flapper 18 and seat 16. Similarly, this adjustment should be such that the equalizing valve 50 closes before the flapper 18 starts to close thereby limiting the flow of fluid through the equalizing valve when the safety valve 10 closes.

Referring now to FIG. 1C, it is also noted that a lower seal 80 is provided in the path of travel of the flow tube 22 so as to engage the flow tube 22 when the valve 10 is in the open position. This allows the flow tube 22 to act as a barrier between the equalizing line 42 and the bore 14 when the valve 10 is in the open position thereby preventing fluid flow through the equalizing line 42, again for the purpose of limiting erosion in the equalizing means.

Referring now to FIG. 1A, the inside of the housing 12 includes an annular recess 82 in communication with the port 46 of the equalizing 42 at a position above the valve element 54 and valve seat 52. This gives the valve 10 the ability to set a blanking plug, pressure the tubing in bore 14 and pump through the equalizing means for cleaning the valve 50 and line 42 such as using a conventional solvent such as varsol.

In operation, when it is desired to open the valve 10, hydraulic control pressure is applied to the control line 32 and passageways 33 and 60. With the flapper 18 in the closed position, the fluid forces and spring forces on the equalizing valve 50 are adjusted to cause the equalizing valve 50 to open prior to and at a lower hydraulic control pressure than the movement of the pistons 40 to cause the flapper 18 to open. This allows equalizing of the pressure across the closed flapper 18. During this time, the labyrinth passageway 70 creates a plurality of pressure drops along the passageway 70 to reduce the velocity of fluid flow through the valve seat 52 and around the valve element 54 thereby reducing erosion. While the equalizing time may be longer than usual, the time may be adjusted by varying the length and allowance of the labyrinth passageway 70 to optimize the length of operation as a function of the desired pressure drop and fluid velocities.

After the valve 10 has been suitably equalized, additional fluid pressure from the control line 32 will act upon the pistons 40 to move the flow tube 22 downwardly to move the flapper 18 off of the seat 16 thereby opening the valve. The flapper 22 will move downwardly and engage the lower seal 80 thereby blocking the lower end 44 of the equalizing line 42 from the well bore 14 thereby preventing fluid flow through the equalizing means while the valve 10 is open. When it is desired to close the valve 10, the hydraulic control pressure in the line 32 is reduced and the valve 50 has been adjusted to insure that the equalizing valve 50 closes before the flapper 18 begins to close thereby limiting the fluid flow through the open equalizing valve 50 as the main valve closes.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. In combination with a subsurface well safety valve for controlling fluid flow through a well tubing and having a housing, a first valve being movable between an open and closed position for controlling flow through the housing, a flow tube telescopically movable in the housing for controlling the opening and closing of said first valve, and means for moving the flow tube for opening and closing the first valve, of an equalizing means for reducing the pressure differential across the first valve when opening said first valve comprising, an equalizing line in communication with the inside of said housing between points below and above the first valve, an equalizing valve in said line, said equalizing valve opening prior to the opening of the first valve, a labyrinth passageway in said equalizing line upstream of the equalizing valve for providing pressure drops for controlling the velocity of the fluid flowing through the equalizing valve, said equalizing line and valve are in the housing, and said housing includes an annular recess in communication with the equalizing line for receiving a blanking plug for pumping cleaning fluid through the equalizing valve.

2. In combination with a subsurface well safety valve for controlling fluid flow through a well tubing and having a housing with a bore therethrough, a first valve moving between open and closed positions for controlling the fluid flow through the bore, a flow tube telescopically moving in the housing for controlling the movement of the first valve, means for biasing the flow tube in an upward direction for causing the first valve to move to the closed position, a piston and cylinder assembly positioned in the housing, one of which is connected to the flow tube and the other of which is adapted to be in communication with hydraulic fluid extending to the well surface for moving the first valve downwardly to the open position, of an equalizing means for reducing the pressure differential across the first valve while opening said first valve comprising, said housing including an equalizing line in communication with the bore between points below and above the first valve, an equalizing valve in said line, said equalizing valve adapted to be in communication with hydraulic fluid from the well surface, said equalizing valve opening prior to the opening of the first valve, a labyrinth passageway in said equalizing line upstream of the equalizing valve for providing pressure drops for controlling the velocity of the fluid flowing through the equalizing valve, and a seal in said housing in position for engagement by the flow tube, said seal being below the equalizing line whereby the flow tube will block fluid flow through the equalizing line.

3. The apparatus of claim 2 wherein the labyrinth passageway includes a plurality of grooves and ridges.

4. The apparatus of claim 2 wherein the housing includes an annular recess in communication with the equalizing line above the equalizing valve for pumping cleaning fluid through the equalizing valve.

5. The apparatus of claim 2 wherein the area of the equalizing valve exposed to hydraulic control fluid is approximately equal to the area of the equalizing valve exposed to pressure in the bore below the first valve.

6. The apparatus of claim 2 wherein said equalizing valve closes before the first valve starts to close thereby preventing flow through the equalizing valve when the first valve closes.

7. The apparatus of claim 6 wherein the cross-sectional area of the equalizing valve is at least twice the cross-sectional area of the labyrinth passageway.

* * * * *